US011569011B2

(12) United States Patent
Howard et al.

(10) Patent No.: US 11,569,011 B2
(45) Date of Patent: Jan. 31, 2023

(54) METHOD AND APPARATUS FOR REINFORCING A CABLE USED IN HIGH FREQUENCY APPLICATIONS

(71) Applicant: John Howard, Upper Mount Bethel, PA (US)

(72) Inventors: John Howard, Upper Mount Bethel, PA (US); Wenny Lin, Upper Mount Bethel, PA (US); Xiao Chu Mei, Chatham, NJ (US)

(73) Assignee: John Howard, Upper Mount, PA (US)

( * ) Notice: Subject to any disclaimer, the term of this patent is extended or adjusted under 35 U.S.C. 154(b) by 393 days.

(21) Appl. No.: 15/343,982

(22) Filed: Nov. 4, 2016

(65) Prior Publication Data

US 2018/0130576 A1 May 10, 2018

(51) Int. Cl.
*H01B 13/26* (2006.01)
*H01R 24/40* (2011.01)
*H01B 7/24* (2006.01)

(52) U.S. Cl.
CPC ..... *H01B 13/26* (2013.01); *H01R 24/40* (2013.01); *H01B 7/24* (2013.01)

(58) Field of Classification Search
CPC ..... B23K 3/08; B23K 3/087; B23K 3/00; B23K 3/02; B23K 1/0008; B23K 3/03–0376; B65H 81/02; B65H 81/04; B65H 81/08; B29C 53/562; B29C 53/58; B29C 53/582; B29C 53/60; B29C 53/66; B29C 53/665; H01B 13/26; H01B 7/24
USPC ..... 219/209, 230, 233, 234
See application file for complete search history.

(56) References Cited

U.S. PATENT DOCUMENTS 298,751 A * 5/1884 Harrington ..... H01B 7/226 174/109
1,526,572 A * 2/1925 Ten Eyck ..... H01B 13/282 242/441.2
2,041,842 A * 5/1936 Layton ..... H01B 11/00 174/121 R
2,118,584 A * 5/1938 Aime ..... H01B 9/0611 138/28
2,134,771 A * 11/1938 Aime ..... H01B 7/226 174/106 SC (Continued)

FOREIGN PATENT DOCUMENTS

DE 4235722 C1 * 4/1994 ..... B23K 3/06
GB 478891 A * 1/1938 ..... H01B 7/24

(Continued)

*Primary Examiner* — Keith Walker
*Assistant Examiner* — Carlos J Gamino
(74) *Attorney, Agent, or Firm* — FisherBroyles, LLP

(57) ABSTRACT

A method and apparatus of reinforcing a cable includes wrapping a flexible wire around at least a portion of an external surface of the cable, and soldering the flexible wire to the cable, thereby positioning the flexible wire with respect to the cable. The portion of the external surface of the cable wrapped with the flexible wire may be disposed between the cable and a connector, or represent an entire length of the cable. Wrapping the flexible wire may involve wrapping the flexible wire around a portion of the external surface of the cable such that coils of the flexible wire are disposed apart from each other, and sliding the coils together such that the coils of the flexible wire are touching each other.

5 Claims, 5 Drawing Sheets

(56) References Cited

U.S. PATENT DOCUMENTS 2,215,292 A * 9/1940 Kosclerzyna ..... H02G 11/003 248/51
2,250,042 A * 7/1941 Sundt ..... H01R 13/562 267/166.1
2,527,172 A * 10/1950 Beaver ..... H01B 7/22 174/25 G
2,866,843 A * 12/1958 Arman ..... H01B 9/0611 174/109
3,006,064 A * 10/1961 Watson ..... B23K 31/025 228/119
3,580,462 A * 5/1971 Vanyi ..... B23K 1/018 219/230
3,800,068 A * 3/1974 Torgerson ..... H01B 7/24 174/135
3,876,167 A * 4/1975 Nittschalk ..... B21C 47/12 242/483.3
3,990,622 A * 11/1976 Schurman, Jr. ..... B23K 3/0615 228/53
4,109,099 A * 8/1978 Dembiak ..... H01B 7/292 174/120 SR
4,336,420 A * 6/1982 Benz ..... H01B 12/02 174/15.5
4,555,054 A * 11/1985 Winter ..... G02B 6/4488 385/103
4,629,145 A * 12/1986 Graham ..... B65H 54/2866 242/483.3
4,678,886 A * 7/1987 Kawaguchi ..... B23K 3/0615 219/85.1
4,694,122 A * 9/1987 Visser ..... H01B 13/26 156/53
5,212,350 A * 5/1993 Gebs ..... H01B 13/228 156/50
5,485,870 A * 1/1996 Kraik ..... B21F 17/00 138/121
5,811,051 A * 9/1998 Kikuchi ..... B29C 53/305 264/409
5,824,960 A * 10/1998 Markling ..... B60D 1/62 174/135
5,878,939 A * 3/1999 Luchinger ..... H01L 24/743 222/592
6,369,359 B1 * 4/2002 Morrison ..... B23K 3/0615 219/229
6,742,702 B2 * 6/2004 Abe ..... B23K 1/012 228/220
2010/0093448 A1 * 4/2010 Markham ..... A61B 17/12022 464/56
2010/0146922 A1 * 6/2010 Greenwood ..... B01D 39/083 55/523
2017/0338009 A1 * 11/2017 van der Laan ..... H01B 12/08

FOREIGN PATENT DOCUMENTS

JP 60019670 A * 1/1985 ..... B65H 81/08
JP 2011224657 A * 11/2011 ..... B23K 1/012

* cited by examiner

METHOD AND APPARATUS FOR REINFORCING A CABLE USED IN HIGH FREQUENCY APPLICATIONS

BACKGROUND

Field

The disclosed embodiments relate to high frequency, radio frequency, and microwave signal applications. More particularly, the disclosed embodiments relate to a method of reinforcing a cable, which may be used to transfer high frequency, radio frequency, and microwave signals, which renders the cable less prone to fracturing, fatigue, and/or breakage due to, for example, shock, vibration, and other types of stress.

Related Art

Cables used in conjunction with high frequency, radio frequency, and microwave applications and components are ordinarily coupled using soldered connections, although brazing, welding, and/or other alternative heat-based techniques may also be used under certain conditions. Unfortunately, the amount of heat used during these connection techniques, as well as the environment to which the cables are subjected, which often includes substantial amounts of shock, vibration, and other types of stress, often results in fatigue, fracturing, and/or breakage along the cables, or at a point of connection between the cable and other components and/or connectors.

SUMMARY

The embodiments disclosed herein include a method of reinforcing a cable used in at least one of high frequency, radio frequency, microwave signal applications, which includes wrapping a flexible wire around at least a portion of an external surface of a cable, and soldering the flexible wire to the cable, thereby positioning the flexible wire with respect to the cable.

The portion of the external surface of the cable wrapped with the flexible wire may be disposed between the cable and a connector, and the cable may be a semi-rigid cable. The connector may be a BNC connector, and the portion of the cable wrapped with the wire may be an entire length of the cable. The method may include wrapping the flexible wire around the portion of the external surface of the cable such that coils of the flexible wire are disposed apart from each other, and sliding the coils together such that the coils of the flexible wire are touching each other.

The embodiments disclosed herein include an apparatus that reinforces a cable used in at least one of high frequency, radio frequency, microwave signal applications, which includes a wire wrapping unit, and a soldering unit. The wire wrapping unit wraps a flexible wire around at least a portion of an external surface of a cable, and the soldering unit solders the flexible wire to the cable, thereby positioning the flexible wire with respect to the cable.

The portion of the external surface of the first cable wrapped with the wire may be disposed between the cable and a connector, and the cable may be a semi-rigid cable. The connector may be a BNC connector, the portion of the cable wrapped with the wire may be an entire length of the cable. The wire wrapping unit may wrap the flexible wire around the portion of the external surface of the cable such that coils of the flexible wire are disposed apart from each other, and the wrapping unit may slide the coils together such that the coils of the flexible wire are touching each other.

The embodiments disclosed herein may include a computer-readable medium including instructions that, when executed by a processing device, perform a method of reinforcing a cable used in at least one of high frequency, radio frequency, microwave signal applications. The method includes wrapping a flexible wire around at least a portion of an external surface of a cable, and soldering the flexible wire to the cable, thereby positioning the flexible wire with respect to the cable.

Other embodiments will become apparent from the following detailed description considered in conjunction with the accompanying drawings. It is to be understood, however, that the drawings are designed as an illustration only and not as a definition of the limits of any of the embodiments.

BRIEF DESCRIPTION OF THE DRAWINGS

The following drawings are provided by way of example only and without limitation, wherein like reference numerals (when used) indicate corresponding elements throughout the several views, and wherein.

It is to be appreciated that elements in the figures are illustrated for simplicity and clarity. Common but well-understood elements that are useful or necessary in a commercially feasible embodiment are not shown in order to facilitate a less hindered view of the illustrated embodiments.

DETAILED DESCRIPTION

Cables used in high frequency, radio frequency, and microwave signal applications, are not typically protected against fatigue and breakage. However, embodiments disclosed herein present a solution by which fatigue, cracking, and/or breaking of these cables can be substantially reduced or eliminated. These features enable the cable to avoid breakage, such as that caused by vibration, high-temperature, or ultraviolet-intensive environments; fatigue, such as that caused by heat-based connection techniques; shock; and the like in a cost-effective manner.

Figure 1:
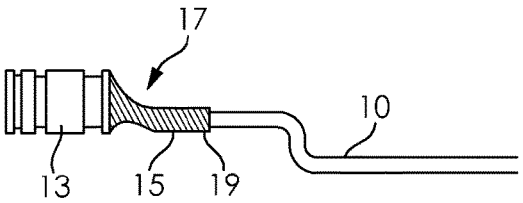
FIG. 1 is a side elevational view showing an embodiment of a cable used in high frequency, radio frequency, or microwave applications following application of the disclosed method of reinforcement.

FIG. 1 shows a side elevational view of a cable 10 used in high frequency, radio frequency, or microwave applications, which is soldered to a connector 13. In this embodiment the cable 10 is a semi-rigid cable, but may be any type of cable, and may be thicker or thinner than the cable 10 shown in FIG. 1. A flexible wire 15 is wrapped around a portion 17 of the cable 10, and the wire 15 is attached to the cable 10 by, for example, soldering the wire 15 to the cable 10. Thus, the wire 15 forms a coil 19 around the portion 17 of the cable 10 near the connector 13 in the completed arrangement shown in FIG. 1. The completed arrangement enables the cable 10 to resist breaking, fracturing, and/or separation from the connector 13 under various, potentially extreme environments and physical conditions.

Figure 2:
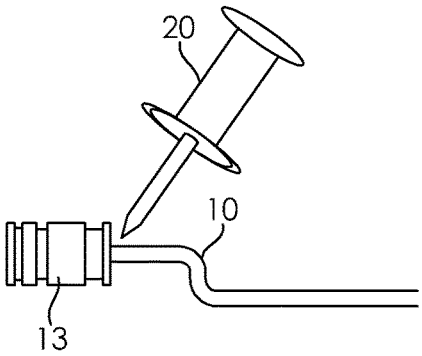
FIG. 2 is a side elevational view showing attachment of the cable to a connector via soldering.

FIGS. 2-8 show individual steps in an embodiment of a method for reinforcing a cable. FIG. 2 shows a side elevational view of the cable 10 displaying attachment of the cable 10 to the connector 13 via soldering. A soldering iron 20 is used to solder the cable 10 to the connector 13. The connector 13 may be a coaxial connector, such as a Bayonet Neill-Concelman (BNC) connector, or any other connector used in connection with high frequency, radio frequency, or microwave, applications and the like, including those described in U.S. military standard MIL-PRF-39012, which is incorporated by reference herein in its entirety.

Figure 3:
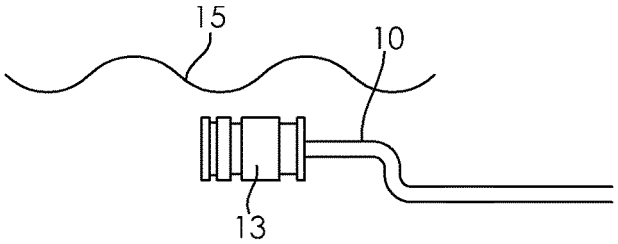
FIG. 3 is a side elevational view showing a wire prior to its attachment to the cable and connector.

FIG. 3 shows a side elevational view of the wire 15 prior to its attachment to the cable 10 and connector 13. Although the wire 15 is visible, the wire 15 is not yet positioned on the cable 10 or wrapped around the cable 10.

Figure 4:
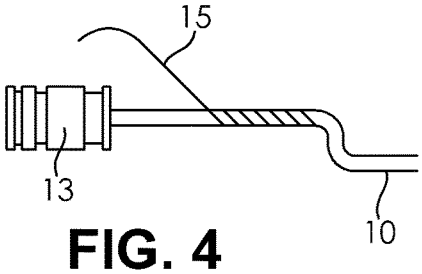
FIG. 4 is a side elevational view showing the wire being wrapped around the cable.

FIG. 4 is a side elevational view showing the wire 15 being wrapped around the cable 10. The wire 15 forms coils 19 around the cable 10. The coils 19 of the wire 15 are disposed apart from each other.

Figure 5:
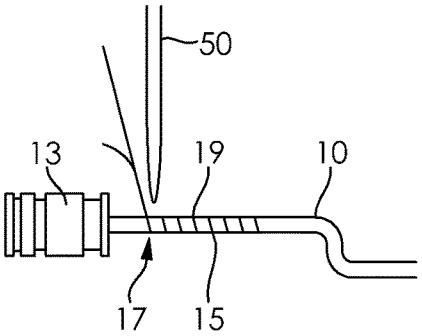
FIG. 5 is a side elevational view showing further wrapping of the wire around the cable using tweezers to guide the wire around the cable.

FIG. 5 shows further wrapping of the wire 15 around the cable 10, with the wire 15 being wrapped in a direction towards the portion 17 of the cable 10 located near the connector 13. Tweezers 50 may be used to guide the wire 15 around the cable 10.

Figure 6:
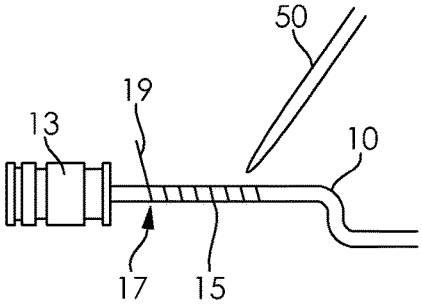
FIG. 6 is a side elevational view showing the wire being pushed towards a portion of the cable located near the connector.

FIG. 6 shows the coils 19 of wire 15 being pushed closer towards the portion 17 of the cable 10 located near the connector 13, and the coils 19 of the wire 15 being pushed increasingly closer to each other. Again, the tweezers 50 may be used to urge the coils 19 together and towards the connector 13. As shown in FIG. 6, the coils 19 of the wire 15 are pushed increasingly closer to each other with the tweezers 50 in the direction of portion 17 of the cable 10.

Figure 7:
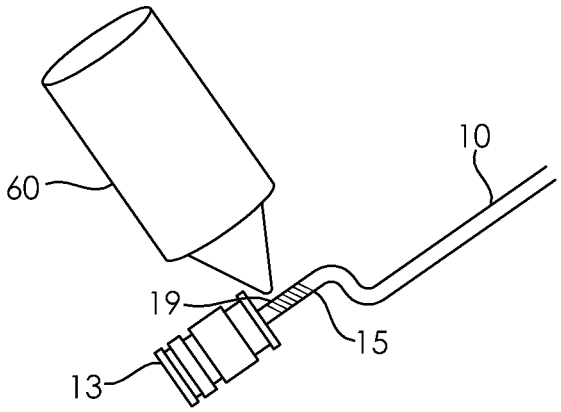
FIG. 7 is a side elevational view showing preparation of the wire for soldering to the cable.

FIG. 7 shows the coils 19 of the wire 15 wrapped around the portion 17 of the cable 10 located near the connector 13. The coils 19 of the wire 15 have been, at this point, urged together so that the coils 19 touch each other. The coils 19 of the wire 15 are prepared for soldering by, for example, applying flux from a dispenser 60. Alternative and/or additional steps may be involved in preparing the wire 15 for soldering, as would be known by one of ordinary skill in the art.

Figure 8:
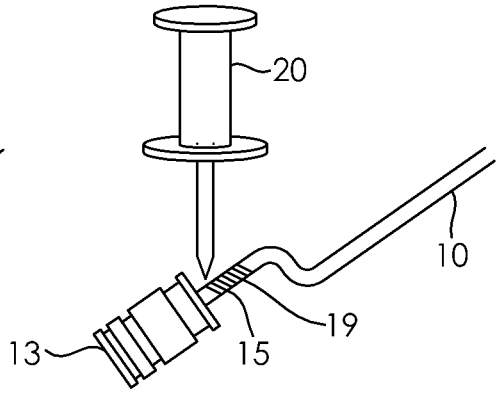
FIG. 8 is a side elevational view showing attachment of the cable to the wire using a soldering iron.

FIG. 8 shows attachment of the wire 15 to the cable 10 using, for example, a soldering iron 20. Alternatively, brazing, welding, or any other alternative technique may be used in place of soldering to connect the wire 15 to the cable 10.

Figure 9:
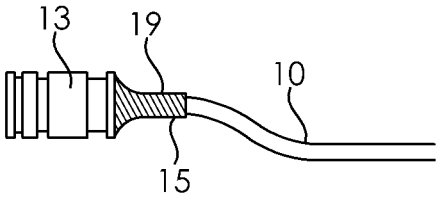
FIG. 9 is a side elevational view showing the cable attached to the connector with the flexible wire coiled around and soldered to the cable.

FIG. 9 shows a side elevational view of the cable 10 attached to the connector 13, with the flexible wire 15 coiled around and soldered to the cable 10. All or a portion of wire 15 that is wrapped around the cable 10 may be soldered to the cable 10 in accordance with any disclosed embodiments.

Figure 10:
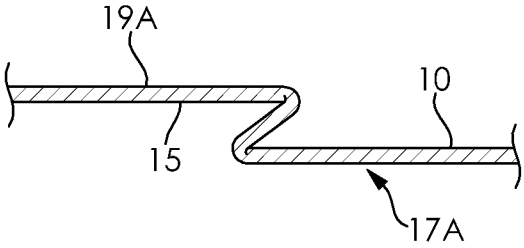
FIG. 10 is a side elevational view of another embodiment of the cable, in which a portion of the cable wrapped with the flexible wire represents all or a portion of a length of the cable.

FIG. 10 shows a side elevational view of another embodiment of the cable 10. In this embodiment, a portion 17A of the cable 10 is wrapped with the flexible wire 15 along all or a portion of a length of the cable 10. Coils 19A of the flexible wire 15, therefore, protect the cable 10 and ensure that the cable 17A is substantially more rigid and less prone to fracturing, fatigue, and/or breakage than that portion of the cable 10 that is not wrapped with the wire 15.

Figure 11:
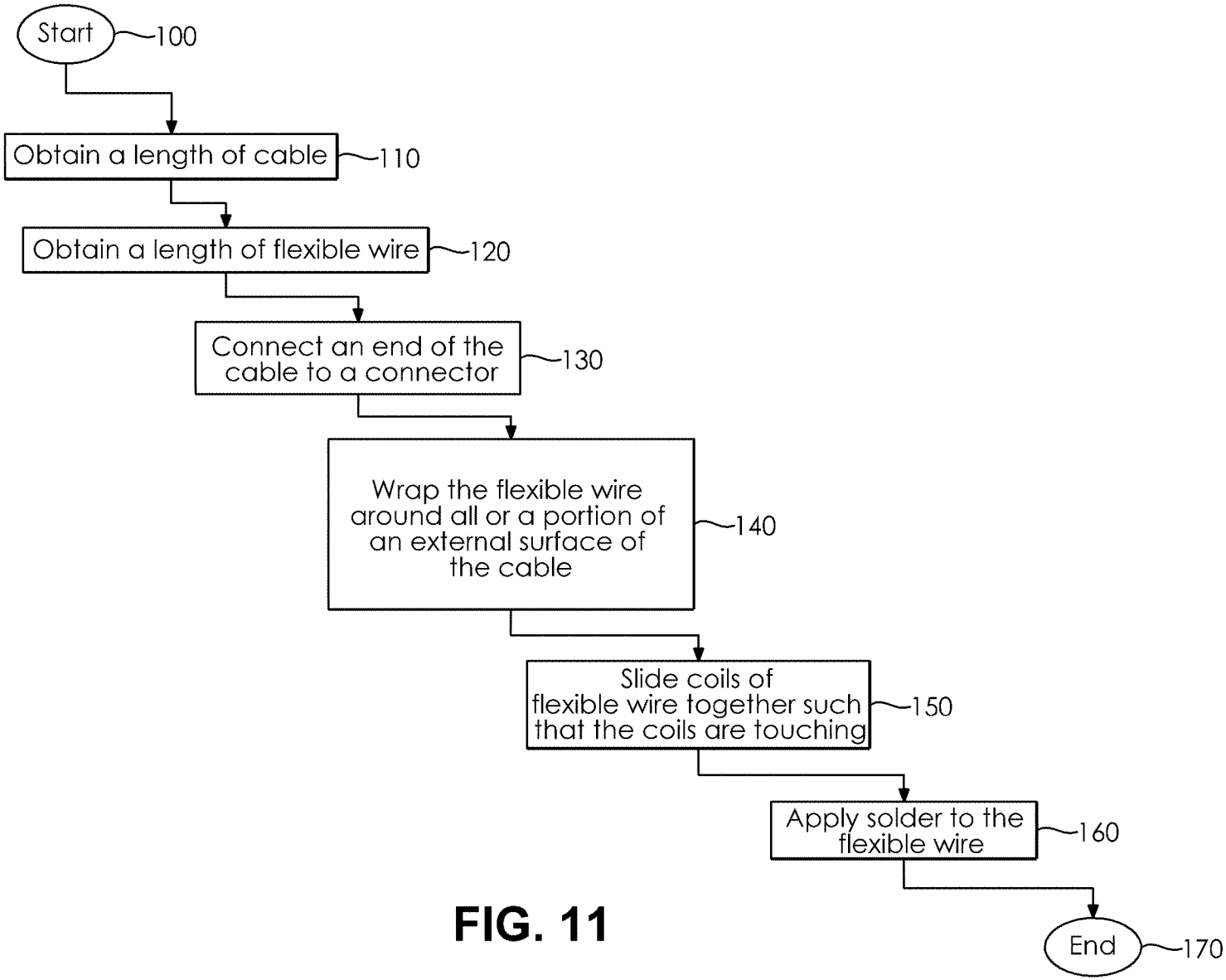
FIG. 11 is flowchart of an embodiment of a method for reinforcing a cable.

FIG. 11 is a flowchart of an embodiment of a method for reinforcing a cable. At step 110, a length of cable is obtained, and at step 120, a length of flexible wire is. At step 130, an end of the cable is attached to a connector, such as by using a heat-based attachment method including soldering, welding, or brazing. The connector is of a type used in high frequency, radio frequency, or microwave applications, such as a BNC connector. At step 140, the flexible wire is wrapped around all or a portion of an external surface of the cable, such that coils of the wire are disposed apart from each other. In some embodiments, the portion of the cable being wrapped may include just an area between the cable and the connector, an entire length of the cable, or any other portion of the cable in order to render the cable less prone to fracturing, fatigue, and/or breakage. At step 150, the coils of the flexible wire are slid together such that the coils are touching. This may be done with tweezers, or by a machine adapted for this purpose. At step 160, solder is applied to the flexible wire, thereby securing the wire to the cable.

Figure 12:
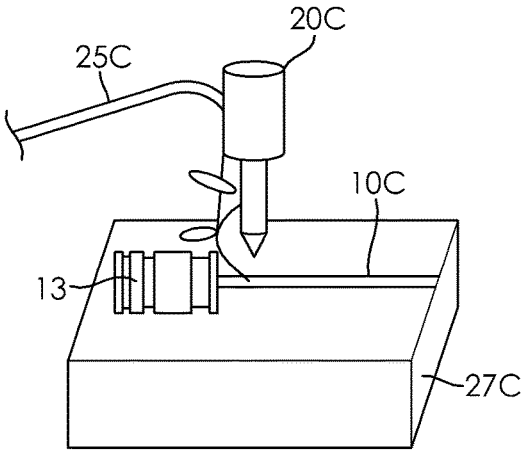
FIG. 12 is an isometric view showing attachment of the cable to a connector using a soldering device.

FIGS. 12-16 show components used in an embodiment of an apparatus for reinforcing a cable. FIG. 12 shows an isometric view of the cable 10 being attached to the connector 13 via soldering. The soldering is performed by a soldering unit 20C, such as an automatic soldering machine. The soldering unit 20C includes a supply tube 25C that provides solder and electrical power to a heating element in the soldering unit 20C. A soldering table 27C holds the cable 10 and connector 13 in place during operation.

Figure 13:
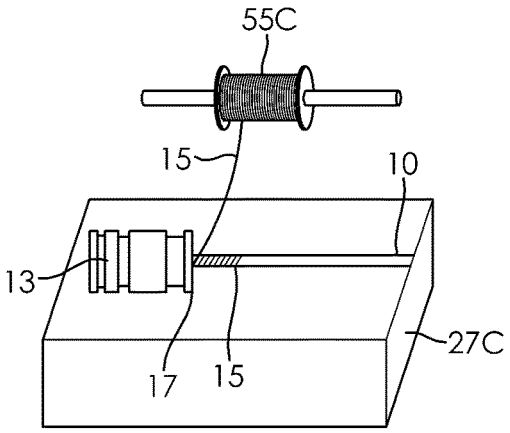
FIG. 13 is an isometric view showing wrapping of the flexible wire around a portion of the cable using a wire wrapping device.

FIG. 13 shows an isometric view of the cable 10 after being attached to the connector 13 and being wrapped with the flexible wire 15 around the portion 17 of the cable 10. The portion 17 of the cable 10 is disposed between the cable 10 and the connector 13. The cable 10 and connector 13 are held in place by the soldering table 27C. A wire wrapping unit 55C, such as a powered wire spool, holds the flexible wire 15 for disbursement. The flexible wire 15 is wrapped around the portion 17 of the cable 10 by, for example, rotating the cable 10 on the soldering table 27C.

Figure 14:
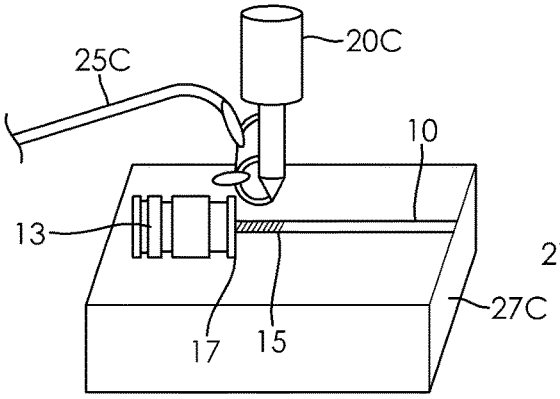
FIG. 14 is an isometric view showing soldering of the flexible wire to the cable after wrapping the wire around the portion of the cable.

FIG. 14 shows an isometric view of the flexible wire 15 being soldered to the cable 10. After the wrapping the flexible wire 15 around the cable 10, the soldering unit 20C is used to solder the flexible wire 15 to the cable 10 at portion 17 of the cable 10, thereby positioning the flexible wire 15 with respect to the cable 10.

Figure 15:
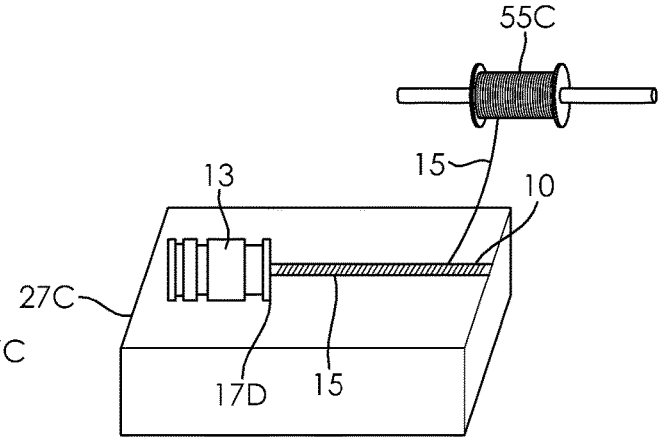
FIG. 15 is an isometric view showing wrapping of the flexible wire around an entire length of the cable with the wire wrapping device.

FIG. 15 shows isometric view of another embodiment, in which the cable 10 has been attached to the connector 13 and wrapped with the flexible wire 15 at a portion 17D of the cable 10. In this embodiment, the portion 17D of the cable 10 is an entire length of the cable 10. As shown in FIG. 13, the wire wrapping unit 55C provides the flexible wire 15 for wrapping around the cable 10. The cable 10 and connector 13 are also held in place by the soldering table 27C.

Figure 16:
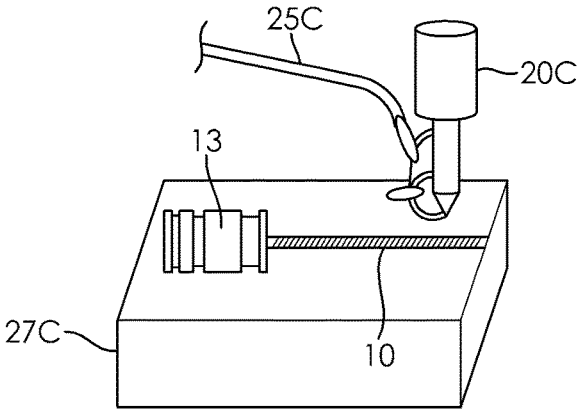
FIG. 16 is an isometric view showing soldering of the flexible wire to the cable after wrapping the wire around the entire length of the cable with the wire wrapping device.

FIG. 16 shows an isometric view of the flexible wire 15, which has been wrapped around the cable 10, being soldered to the cable 10. As discussed previously, the portion 17 of the cable 10 may include just the portion between the cable 10 and the connector 13, the entire length of the cable 10, or any other portion of the cable 10 to be rendered less prone to fracturing, fatigue, and/or breakage.

It is to be noted that all or any portion or portions of the cable 10 may be wrapped and/or soldered with the wire 15 in accordance with any of the disclosed embodiments. It is also to be noted that all or any portion or portions of the cable 10 may be straight, bent, or curved prior, during, and/or after being wrapped and/or soldered with the wire 15 in accordance with any of the disclosed embodiments.

Figure 17:
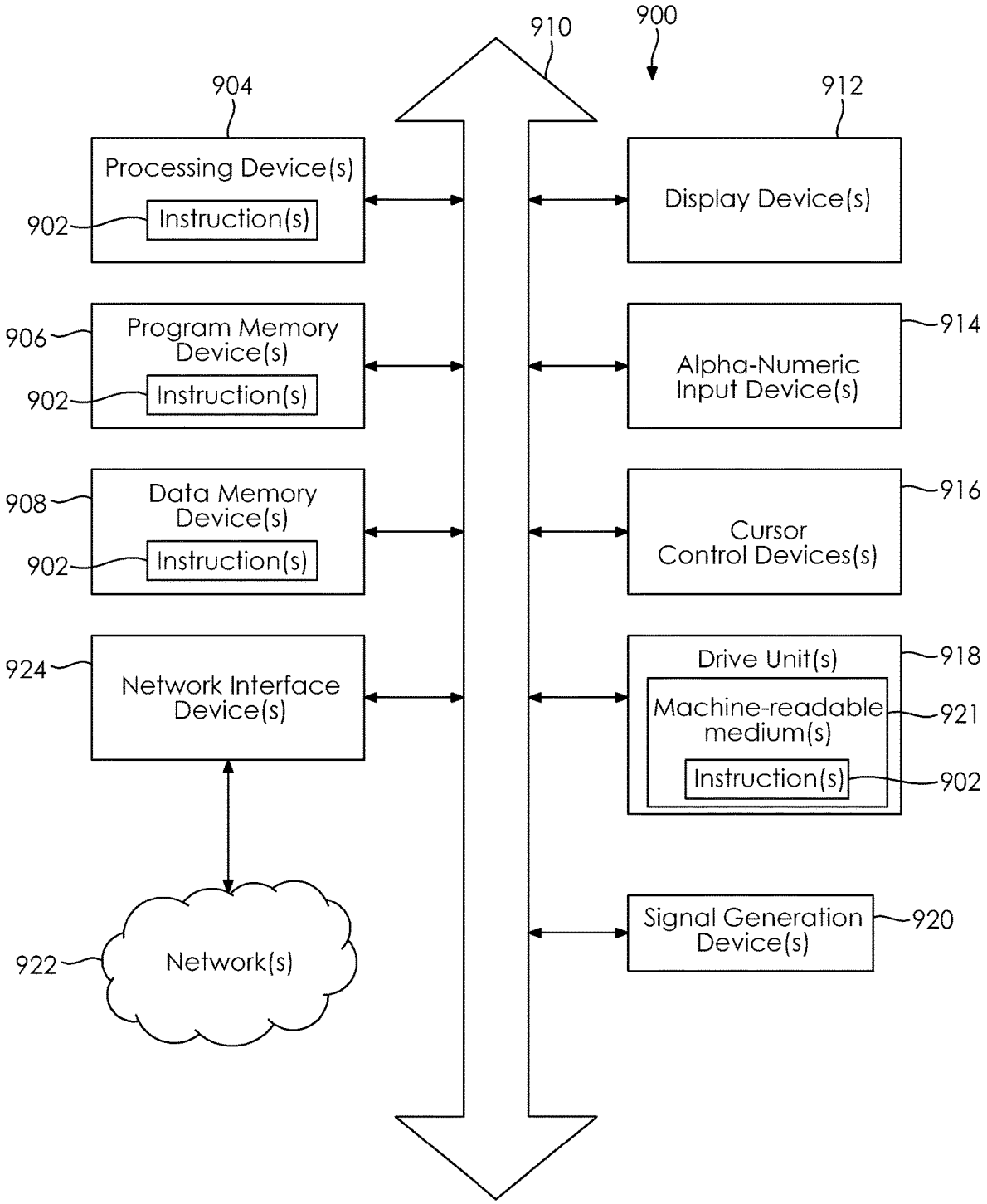
FIG. 17 shows a block diagram of at least a portion of an exemplary machine in the form of a computing system that performs methods according to one or more embodiments disclosed herein.

One or more embodiments disclosed herein, or a portion thereof, may make use of software running on a computer or workstation. By way of example, only and without limitation, FIG. 17 is a block diagram of an embodiment of a machine in the form of a computing system 900, within which is a set of instructions 902 that, when executed, cause the machine to perform any one or more of the methodologies according to embodiments of the invention. In one or more embodiments, the machine operates as a standalone device; in one or more other embodiments, the machine is connected (e.g., via a network 922) to other machines. In a networked implementation, the machine operates in the capacity of a server or a client user machine in a server-client user network environment. Exemplary implementations of the machine as contemplated by embodiments of the invention include, but are not limited to, a server computer, client user computer, personal computer (PC), tablet PC, personal digital assistant (PDA), cellular telephone, mobile device, palmtop computer, laptop computer, desktop computer, communication device, personal trusted device, web appliance, network router, switch or bridge, or any machine capable of executing a set of instructions (sequential or otherwise) that specify actions to be taken by that machine.

The computing system 900 includes a processing device(s) 904 (e.g., a central processing unit (CPU), a graphics processing unit (GPU), or both), program memory device(s) 906, and data memory device(s) 908, which communicate with each other via a bus 910. The computing system 900 further includes display device(s) 912 (e.g., liquid crystal display (LCD), flat panel, solid state display, or cathode ray tube (CRT)). The computing system 900 includes input device(s) 914 (e.g., a keyboard), cursor control device(s) 916 (e.g., a mouse), disk drive unit(s) 918, signal generation device(s) 920 (e.g., a speaker or remote control), and network interface device(s) 924, operatively coupled together, and/or with other functional blocks, via bus 910.

The disk drive unit(s) 918 includes machine-readable medium(s) 926, on which is stored one or more sets of instructions 902 (e.g., software) embodying any one or more of the methodologies or functions herein, including those methods illustrated herein. The instructions 902 may also reside, completely or at least partially, within the program memory device(s) 906, the data memory device(s) 908, and/or the processing device(s) 904 during execution thereof by the computing system 900. The program memory device(s) 906 and the processing device(s) 904 also constitute machine-readable media. Dedicated hardware implementations, such as but not limited to ASICs, programmable logic arrays, and other hardware devices can likewise be constructed to implement methods described herein. Applications that include the apparatus and systems of various embodiments broadly comprise a variety of electronic and computer systems. Some embodiments implement functions in two or more specific interconnected hardware modules or devices with related control and data signals communicated between and through the modules, or as portions of an ASIC. Thus, the example system is applicable to software, firmware, and/or hardware implementations.

The term "processing device" as used herein is intended to include any processor, such as, for example, one that includes a CPU (central processing unit) and/or other forms of processing circuitry. Further, the term "processing device" may refer to more than one individual processor. The term "memory" is intended to include memory associated with a processor or CPU, such as, for example, RAM (random access memory), ROM (read only memory), a fixed memory device (for example, hard drive), a removable memory device (for example, diskette), a flash memory and the like. In addition, the display device(s) 912, input device(s) 914, cursor control device(s) 916, signal generation device(s) 920, etc., can be collectively referred to as an "input/output interface," and is intended to include one or more mechanisms for inputting data to the processing device(s) 904, and one or more mechanisms for providing results associated with the processing device(s). Input/output or I/O devices (including but not limited to keyboards (e.g., alpha-numeric input device(s) 914, display device(s) 912, and the like) can be coupled to the system either directly (such as via bus 910) or through intervening input/output controllers (omitted for clarity).

In an integrated circuit implementation of one or more embodiments of the invention, multiple identical die are typically fabricated in a repeated pattern on a surface of a semiconductor wafer. Each such die may include a device described herein, and may include other structures and/or circuits. The individual dies are cut or diced from the wafer, then packaged as integrated circuits. One skilled in the art would know how to dice wafers and package die to produce integrated circuits. Any of the exemplary circuits or method illustrated in the accompanying figures, or portions thereof, may be part of an integrated circuit. Integrated circuits so manufactured are considered part of this invention.

An integrated circuit in accordance with the embodiments of the present invention can be employed in essentially any application and/or electronic system in which buffers are utilized. Suitable systems for implementing one or more embodiments of the invention include, but are not limited, to personal computers, interface devices (e.g., interface networks, high-speed memory interfaces (e.g., DDR3, DDR4), etc.), data storage systems (e.g., RAID system), data servers, etc. Systems incorporating such integrated circuits are considered part of embodiments of the invention. Given the teachings provided herein, one of ordinary skill in the art will be able to contemplate other implementations and applications.

In accordance with various embodiments, the methods, functions or logic described herein is implemented as one or more software programs running on a computer processor. Dedicated hardware implementations including, but not limited to, application specific integrated circuits, programmable logic arrays and other hardware devices can likewise be constructed to implement the methods described herein. Further, alternative software implementations including, but not limited to, distributed processing or component/object distributed processing, parallel processing, or virtual machine processing can also be constructed to implement the methods, functions or logic described herein.

The embodiment contemplates a machine-readable medium or computer-readable medium containing instructions 902, or that which receives and executes instructions 902 from a propagated signal so that a device connected to a network environment 922 can send or receive voice, video or data, and to communicate over the network 922 using the instructions 902. The instructions 902 are further transmitted or received over the network 922 via the network interface device(s) 924. The machine-readable medium also contains a data structure for storing data useful in providing a functional relationship between the data and a machine or computer in an illustrative embodiment of the systems and methods herein.

While the machine-readable medium 902 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding, or carrying a set of instructions for execution by the machine and that cause the machine to perform anyone or more of the methodologies of the embodiment. The term "machine-readable medium" shall accordingly be taken to include, but not be limited to: solid-state memory (e.g., solid-state drive (SSD), flash memory, etc.); read-only memory (ROM), or other non-volatile memory; random access memory (RAM), or other re-writable (volatile) memory; magneto-optical or optical medium, such as a disk or tape; and/or a digital file attachment to e-mail or other self-contained information archive or set of archives is considered a distribution medium equivalent to a tangible storage medium. Accordingly, the embodiment is considered to include anyone or more of a tangible machine-readable medium or a tangible distribution medium, as listed herein and including art-recognized equivalents and successor media, in which the software implementations herein are stored.

It should also be noted that software, which implements the methods, functions and/or logic herein, are optionally stored on a tangible storage medium, such as: a magnetic medium, such as a disk or tape; a magneto-optical or optical medium, such as a disk; or a solid state medium, such as a memory automobile or other package that houses one or more read-only (non-volatile) memories, random access memories, or other re-writable (volatile) memories. A digital file attachment to e-mail or other self-contained information archive or set of archives is considered a distribution medium equivalent to a tangible storage medium. Accordingly, the disclosure is considered to include a tangible storage medium or distribution medium as listed herein and other equivalents and successor media, in which the software implementations herein are stored. Although the specification describes components and functions implemented in the embodiments with reference to particular standards and protocols, the embodiment are not limited to such standards and protocols.

The illustrations of embodiments described herein are intended to provide a general understanding of the structure of various embodiments, and the embodiments are not intended to serve as a complete description of all the elements and features of apparatus and systems that might make use of the structures described herein. Many other embodiments will be apparent to those skilled in the art upon reviewing the above description. Other embodiments are utilized and derived therefrom, such that structural and logical substitutions and changes are made without departing from the scope of this disclosure. Figures are also merely representational and are not drawn to scale. Certain proportions thereof are exaggerated, while others are decreased. Accordingly, the specification and drawings are to be regarded in an illustrative rather than a restrictive sense.

Such embodiments are referred to herein, individually and/or collectively, by the term "embodiment" merely for convenience and without intending to voluntarily limit the scope of this application to any single embodiment or inventive concept if more than one is in fact shown. Thus, although specific embodiments have been illustrated and described herein, it should be appreciated that any arrangement calculated to achieve the same purpose are substituted for the specific embodiments shown. This disclosure is intended to cover any and all adaptations or variations of various embodiments. Combinations of the above embodiments, and other embodiments not specifically described herein, will be apparent to those skilled in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single embodiment. Thus the following claims are hereby incorporated into the detailed description, with each claim standing on its own as a separate example embodiment.

The abstract is provided to comply with 37 C.F.R. § 1.72(b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single embodiment. Thus the following claims are hereby incorporated into the Detailed Description, with each claim standing on its own as separately claimed subject matter.

Although specific example embodiments have been described, it will be evident that various modifications and changes are made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and without limitation, specific embodiments in which the subject matter are practiced. The embodiments illustrated are described in sufficient detail to enable those skilled in the art to practice the teachings herein. Other embodiments are utilized and derived therefrom, such that structural and logical substitutions and changes are made without departing from the scope of this disclosure. This Detailed Description, therefore, is not to be taken in a limiting sense, and the scope of various embodiments is defined only by the appended claims, along with the full range of equivalents to which such claims are entitled.

Given the teachings provided herein, one of ordinary skill in the art will be able to contemplate other implementations and applications of the techniques of the disclosed embodiments. Although illustrative embodiments have been described herein with reference to the accompanying drawings, it is to be understood that these embodiments are not limited to the disclosed embodiments, and that various other changes and modifications are made therein by one skilled in the art without departing from the scope of the appended claims.

What is claimed is:

1. An apparatus that reinforces a cable used in at least one of high frequency, radio frequency, and microwave signal applications, the apparatus comprising:

a wire wrapping unit, the wire wrapping unit configured to wrap a flexible wire around at least a portion of an external surface of a cable, the cable configured to transmit at least one of high frequency, radio frequency, and microwave signals;

a soldering unit, the soldering unit configured to solder the flexible wire to the cable, thereby positioning the flexible wire with respect to the cable, the soldering unit comprising a heating element;

a computing system;

a supply tube that provides solder and electrical power to the heating element in the soldering unit; and a soldering table that holds the cable and a connector in place, wherein the wire wrapping unit is further configured to wrap the flexible wire around substantially an entirety of the external surface of the cable, the soldering unit is further configured to solder to the cable substantially all of the wire that is wrapped around the cable, and the computing system comprises instructions that, when executed, cause the apparatus to wrap and solder the flexible wire to the cable.

2. The apparatus of claim 1, wherein the portion of the external surface of the cable wrapped with the flexible wire is disposed between the cable and the connector.

3. The apparatus of claim 1, wherein the cable is a semi-rigid cable.

4. The apparatus of claim 2, wherein the connector is a BNC connector.

5. The apparatus of claim 1, wherein the wire wrapping unit wraps the flexible wire around the portion of the external surface of the cable such that coils of the flexible wire are disposed apart from each other, the wrapping unit sliding the coils together such that the coils of the flexible wire are touching each other.

* * * * *